United States Patent [19]

Azuhata et al.

[11] Patent Number: 4,907,962

[45] Date of Patent: Mar. 13, 1990

[54] LOW NOX BURNER

[75] Inventors: Shigeru Azuhata, Hitachi; Kiyoshi Narato, Ibaraki; Hironobu Kobayashi, Katsuta; Kenichi Sohma, Hitachi; Tooru Inada, Hitachi; Norio Arashi, Hitachi; Hiroshi Miyadera, Hitachi; Masao Masutani, Katsuta, all of Japan

[73] Assignees: Hitachi, Ltd.; Babcock-Hitachi Kabushiki, both of Tokyo, Japan

[21] Appl. No.: 54,391

[22] Filed: May 26, 1987

[30] Foreign Application Priority Data

May 26, 1986 [JP] Japan ..... 61-119259

[51] Int. Cl.[4] ..... F23C 5/00

[52] U.S. Cl. ..... 431/174; 431/183; 431/284; 431/351; 110/262; 239/404; 239/406

[58] Field of Search ..... 431/174, 182, 183, 184, 431/284, 351, 181, 188, 187; 239/403, 404, 406; 110/261, 262

[56] References Cited

U.S. PATENT DOCUMENTS

| | | | |
|---|---|---|---|
| 3,746,499 | 7/1973 | Guerre et al. | 431/182 |
| 4,381,718 | 5/1983 | Carver et al. | 110/347 |
| 4,412,810 | 11/1983 | Izuha et al. | 110/261 |
| 4,474,120 | 10/1984 | Adrian et al. | 431/284 |
| 4,620,571 | 7/1986 | Chadshay | 431/182 |

FOREIGN PATENT DOCUMENTS

| | | |
|---|---|---|
| 0160146 | 6/1985 | European Pat. Off. . |
| 3106824 | 12/1981 | Fed. Rep. of Germany . |
| 3125901 | 1/1983 | Fed. Rep. of Germany . |
| 212305 | 8/1984 | German Democratic Rep. . |

OTHER PUBLICATIONS

European Patent Application No. 128,085, Buckland, 12-1984, 11 pages.

*Primary Examiner*—Carroll B. Dority
*Attorney, Agent, or Firm*—Antonelli, Terry & Wands

[57] ABSTRACT

A low NOx burner comprises a pulverized coal nozzle for injecting a flow of a mixture of pulverized coal with primary air, a secondary air nozzle arranged externally of and coaxially with the pulverized coal nozzle, a tertiary air nozzle arranged externally of the secondary air nozzle and disposed coaxially with the pulverized coal nozzle, and a swirl flow generator for injecting secondary air and tertiary air as a respective swirl flow. Between the secondary air nozzle and the tertiary air nozzle, there is provided a spacer having such a thickness as to delay the mixing of the secondary air and the tertiary air and to form a swirl flow between the secondary air and the tertiary air.

18 Claims, 9 Drawing Sheets

LOW NOX BURNER

BACKGROUND OF THE INVENTION

The present invention relates to a burner capable of suppressing or reducing production of nitrogen oxide (referred to as NOx hereinafter) in combustion gas, and more particularly, it relates to a low NOx burner for pulverized coal capable of remarkably reducing the NOx production during combustion of the pulverized coal.

Fossilization coal includes nitrogen (N) as well as combustible components such as carbon, hydrogen and the like. Particularly, coal includes a relatively large amount of the nitrogen, unlike gaseous fuel or liquid fuel. Therefore, an amount of the NOx production generated during combustion of the coal is more than that generated during combustion of the gaseous fuel. Thus, it has been desired that such NOx production is reduced or suppressed to the utmost.

NOx generated during combustion of various fuel is grouped into thermal NOx and fuel NOx, on the basis of the cause of its generation. The thermal NOx is generated by oxidization of nitrogen in the firing air; on the other hand, the fuel NOx is generated by oxidization of nitrogen in the fuel.

In order to suppress production of such NOx, various combustion methods have been proposed; one of the representative conventional combustion methods is a staged combustion method in which the firing air is supplied in lots for every stage. Another representative conventional combustion method is an exhaust gas recirculating method in which the exhaust gas having low concentration of oxygen is supplied into a combustion area. A common principle regarding these conventional low NOx combustion methods resides in the matter that reaction between nitrogen and oxygen is suppressed by lowering a flame temperature. However, NOx which can be suppressed by lowering the flame temperature is the thermal NOx; the generation of the fuel NOx is scarcely influenced by the flame temperature. Therefore, the combustion method in which the NOx production is suppressed by lowering the flame temperature is effective merely for the combustion of the fuel containing a low percentage of nitrogen. However, this conventional combustion method is not effective in the combustion of coal, since the NOx generated by the combustion of coal contains about 80% of the fuel NOx, as clarified by D. W. Pershing and J. O. L. Wendt (refer to "The influence of flame temperature and fuel NOx; The Sixteenth Symposium (Inter-rational) on Combustion, P389–399. The Combustion Institute, 1976").

Combustibles in the coal can be grouped into volatile matter (component) and solid component. According to this inherent nature of the coal, the combustion method for the pulverized coal includes a process for pyrolyzing the pulverized coal in which the volatile matter is volatilized or discharged, and a combustion process for burning the combustible solid component (referred to as char hereinafter) after said pyrolysis. Combustion rate of the volatile matter is higher than that of the solid component, and thus, the volatile matter is burned up in an early stage of the combustion. In the above pyrolysis process, nitrogen (N-component) contained in the coal is separated into N-component devolatilized together with the other volatile matter, and N-component retained in the char. Thus, the fuel NOx generated during combustion of the pulverized coal includes NOx obtained from the volatile N-component and NOx obtained from the N-component retained in the char.

However, as pointed out by D. W. Pershing and J. O. L. Wendt, in the case of the combustion of coal, the greater part of the NOx production is NOx obtained from the volatile matter (i.e., the fuel NOx). In view of this fact, it is required to solve a problem regarding the fuel NOx in the combustion of the coal.

It is known that the volatile N-component forms compounds such as $NH_3$, HCN and the like in an early stage of the combustion and in a region wherein oxygen is insufficient. These nitrogenous compounds not only produce NOx by reacting with oxygen but also act as a reducing or deoxidizing agent for resolving NOx into nitrogen by reacting with the produced NOx. This reducing reaction of NOx with the nitrogenous compound proceeds when such compound co-exists with NOx; if the nitrogenous compound does not co-exist with NOx, the greater part of the nitrogenous compound is oxidized to produce NOx. Further, under the high temperature circumstances such as the combustion, this reducing reaction is liable to proceed, as a percentage of oxygen contained in the surrounding atmosphere decreases. Accordingly, in order to suppress the generation of NOx during combustion of coal, it is a technical key how to create such atmosphere containing a low concentration of oxygen (i.e., low oxygen region).

As described in the Japanese Utility Model Laid-Open No. 94004/1982, the Japanese Patent Publication No. 30161/1980 or the literature (D. M. Zallen, R. Gershman, M. P. Heap and W. H. Nurick, "The Generalization of Low Emission Coal Burner Technology" Proceedings of the Third Stationary Source Combustion System, volume II, p. 73–109, 1976), a conventional burner for forming a low oxygen region in a flame, known to date, is a burner for delaying the mixing of excessive air with a fuel rich flame by arranging a secondary firing air nozzle or a tertiary air nozzle remotely from a fuel nozzle.

In the above conventional burner, a secondary or tertiary air is injected as a straight advance jet from the air nozzle radially spaced apart from an outlet of the fuel nozzle. Therefore, in the combustion by means of this conventional burner, it is easy to form the low oxygen region in the fuel rich flame, since the mixing of the excessive air with the fuel rich flame is delayed; however, as the mixing is delayed, combustion time is lengthened, thus worsening combustion efficiency. Further, the above conventional burner has another disadvantage of having a large-sized combustion installation.

SUMMARY OF THE INVENTION

Accordingly, an object of the present invention is to provide a low NOx burner for performing improved mixing of excessive air with a fuel rich flame, and more particularly, to provide improved means for suppressing NOx production, as well as preventing the combustion efficiency from being worsened and also preventing the installation from being enlarged, wherein a region containing a low percentage of oxygen (low oxygen region) is effectively formed in the center of the flame, and, after NOx is deoxidized and reduced in said region, combustibles stay in said region and a combustion air is rapidly mixed at a downstream portion of said low oxygen region.

According to the present invention, the above object is achieved by still improving a method for mixing the combustion air with the fuel.

In accordance with one aspect of the present invention, there is provided a low NOx burner comprising a pulverized coal passage for injecting a flow of a mixture of pulverized coal with primary air, a secondary air passage arranged externally of and coaxially with the pulverized coal passage, a tertiary air nozzle arranged externally of the secondary air passage and disposed coaxially with the pulverized coal passage, swirl flow generator means for injecting secondary air and tertiary air as a respective swirl flow, and spacer means disposed between the secondary air passage and the tertiary air passage and having such a thickness as to delay the mixing of the secondary air with the tertiary air and to form a swirl flow between the secondary air and the tertiary air.

According to another aspect of the present invention, the above low NOx burner further comprises flame holder means provided on a free end of the pulverized coal passage for forming a swirl flow between the flow of the mixture of the pulverized coal with the primary air and a flow of the secondary air.

According to the other aspect of the present invention, the above-mentioned low NOx burner further comprises, in place of the flame holder means, a gaseous fuel nozzle disposed in the spacer means.

In accordance with a fourth aspect of the present invention, the above-mentioned low NOx burner according to said one aspect further comprises both flame holder means provided on a free end of the pulverized coal passage for forming a swirl flow between the flow of the mixture of the pulverized coal with the primary air and a flow of the secondary air, and a gaseous fuel nozzle disposed into the spacer means.

In accordance with a fifth aspect of the present invention, in the above-mentioned low NOx burner according to said one aspect, the pulverized coal passage has a cylindrical or polygonal injecting outlet, the secondary air passage having a secondary air injecting outlet comprising a polygonal reducer disposed to surround the injecting outlet of the pulverized coal passage, the tertiary air passage having a cylindrical or polygonal tertiary air injecting outlet disposed to surround the secondary air injecting outlet.

In the burner according to the present invention, the spacer disposed between the secondary air nozzle and the tertiary air nozzle delays the mixing of the secondary air with the tertiary air by estranging or separating the secondary air from the tertiary air in a radial direction, thereby forming a reduction region for deoxidizing the NOx. Further, the spacer originates a swirl flow between the secondary air flow and the tertiary air flow, thereby improving the holding of flame. The swirl flow generator associated with the tertiary air passage can delay the mixing of the tertiary air with the straight advance flow of the fuel by changing the tertiary air to a swirl flow and can promote, at a downstream portion of the flame, the mixing of the tertiary air with the combustibles retained in the reduction region by the use of a low pressure area originated in said swirl flow, thereby preventing the flame from being lengthened and also preventing the combustion efficiency from being worsened. Further, the tertiary air passage has an extension which extends beyond free or outer ends of the other passages and which defines a section for promoting the formation of the swirl flow of the tertiary air, thus improving efficiency of the generation of the swirl flow of the tertiary air and preventing a phenomenon wherein the tertiary air is liable to be scattered excessively in a radial direction when the strength of the swirl of the tertiary air is increased.

Furthermore, in the present invention, various kinds of coal can be utilized, since flow rates, injecting speeds and the like of the secondary air (for firing and forming the fuel rich flame) and the tertiary air (for achieving complete combustion) can independently be controlled due to the fact that in the construction of the present invention the firing air can independently be supplied as the secondary air and the tertiary air. The swirl flow generator and the spacer disposed between the secondary air passage and the tertiary air passage also act as means for clearly distinguishing the role of the secondary air from that of the tertiary air.

According to the present invention, since the mixing of the air for achieving the perfect combustion (i.e., combustion air) with the flame of low air-to-fuel ratio is delayed in the proximity of the burner so as to originate the reduction region in the flame, the generation of NOx is remarkably suppressed, and the mixing of the combustibles with the combustion air in the downstream portion of the reduction region proceeds rapidly, thereby improving the combustion efficiency as well as suppressing the NOx production.

Lastly, in the present invention, the flow passage of the secondary air (i.e., the secondary air passage) can be constructed to have a polygonal shape and a polygonal reducer constituted by a block can be arranged on the outlet of said passage, so that the swirl of the secondary air is generated at apexes of the polygon to promote deceleration of the fuel jet and that a mixing layer for promoting the mixing of the firing air with the pulverized coal is originated to improve the holding of flame and to promote the firing of the fuel.

DESCRIPTION OF THE PREFERRED EMBODIMENTS

Figure 1:
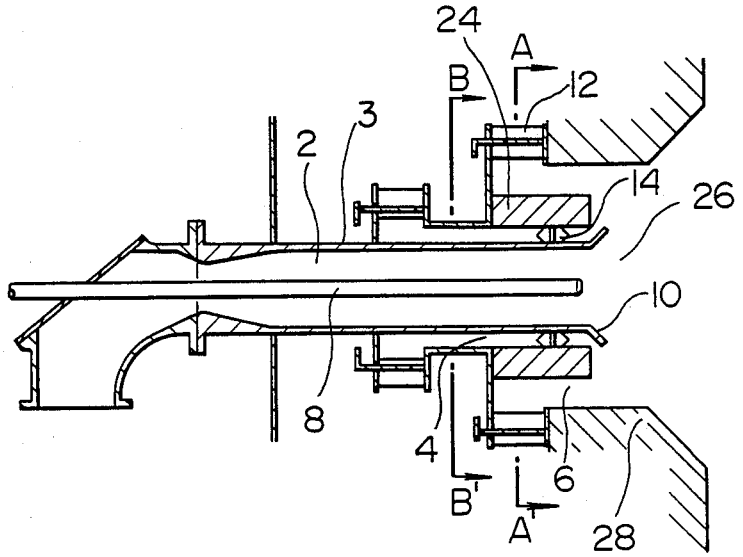
FIG. 1 is a longitudinal sectional view of an embodiment of a burner for pulverized coal according to the present invention.

Preferred embodiments of the present invention will now be described in reference to the attached drawings hereinbelow. FIG. 1 shows a first embodiment of a burner for pulverized coal. The burner shown in FIG. 1 comprises a pulverized coal nozzle 2 defined by a hollow tube 3 for injecting a fluid mixture including pulverized coal and primary air which is carrier air for the pulverized coal, an annular secondary air nozzles 4 arranged around the nozzles 2 for atomizing secondary air, and an annular tertiary air nozzles 6 arranged around the nozzle 4. A liquid fuel nozzle 8 is disposed in the pulverized coal passage 2, which nozzle 8 provides a jet of liquid fuel such as heavy oil and the like when a combustion furnace is preheated. On an outer end of the pulverized coal nozzles 2, there is arranged a flame holder 10 formed by an end portion of the tube 3, which is flared radially outwardly of the tube 3. The flame holder generates a swirl flow by combining the fluid mixture from the nozzles 2 and the secondary air from the nozzles 4, thereby improving the ignitability of the pulverized coal.

Figure 2:
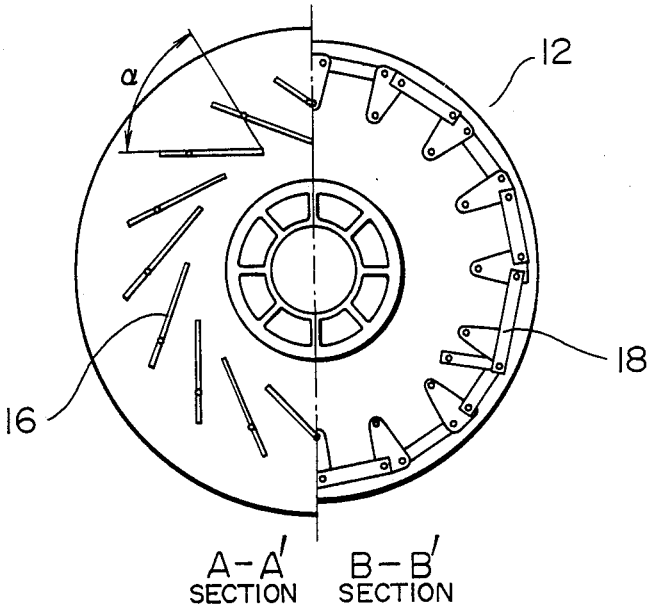
FIG. 2 shows a construction of a swirl flow generator of radial flow type, wherein a left half thereof is a sectional view taken along the line A—A' of FIG. 1 and a right half thereof is a view taken along the line B—B' of FIG. 1.
Figure 3:
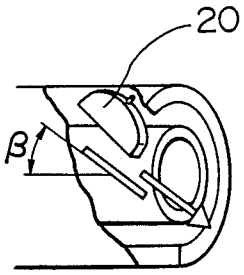
FIG. 3 is a partially broken perspective view showing a swirl flow generator of axial flow type.

Swirl flow generators 14 and 12 associated with the secondary and tertiary air nozzles 4 and 6, respectively, are used for adjusting the swirl level of the secondary air and of the tertiary air, respectively. As shown in FIG. 2, the swirl flow generator 12 associated with the tertiary air passage 6 is a swirl flow generator of radial flow type comprising a plurality of blades or vanes 16 and a mechanism 18 for changing or adjusting an angle $\alpha$ of inclination of the vanes. The generator 12 can adjust a magnitude of a tangential factor (swirl factor) of velocity of the tertiary air flowing out radially, by changing the inclination angle $\alpha$ of the vanes 16. The swirl flow generator 14 attached to the secondary air passage 4 is a swirl flow generator of axial flow type as shown in FIG. 3, which can adjust the strength of the swirl of the secondary air flow, by changing an inclination angle $\beta$ of vanes 20 arranged along a direction of the air flow.

An annular spacer 24 arranged around the tube 3 to define the passage 4 therebetween acts as means for delaying the mixing of the secondary air and the tertiary air. The fuel and the air are atomized or injected into a combustion furnace (not shown) through a throat 26 formed in a block 28 which cooperates with the spacer 24 defining passage 6 therebetween. The block has a straight wall portion (in sectional view shown in FIG. 1) between each of the passage outlets and an enlarged mouth portion of the block.

In the burner for pulverized coal having the construction described above, the pulverized coal injected from the pulverized coal passage 2 is ignited or fired by the primary carrier air and the secondary air, thereby generating a fuel rich flame at a center of the entire flame. This fuel rich flame is stabilized by the flame holder 10 and by adjusting the flow rate and the strength of the swirl of the secondary air. In the burner according to the present invention, since the mixing of the tertiary air and the fuel rich flame is delayed by the spacer 24 disposed between the tertiary air flow and the secondary air flow, in the fuel rich flame, after the oxygen in the combustion air is consumed by the firing, a reduction or deoxidization region with low concentration of oxygen is generated in the proximity of the burner throat 26. The tertiary air is used for the purpose of achieving complete combustion of the residual combustibles after NOx is deoxidized in the reduction region. Thus, after the NOx is deoxidized, it is necessary that the tertiary air is mixed with the central flow rapidly so as to perform the prompt oxidization of the residual combustibles.

In this case, in the conventional burner as described above, wherein the tertiary air is injected in the form of a straight advance flow at a radial position remote from the center of the burner, since the tertiary air flow is slowly mixed with the central flow, the reduction region is formed or generated effectively; however, in this case, since the tertiary air cannot be rapidly mixed with the combustibles retained in the reduction region, the flame is lengthened. This is one of the disadvantages of the above conventional burner. Another disadvantage of the conventional burner is that a relatively large amount of the combustibles is discharged.

On the other hand, in the burner for pulverized coal shown in FIG. 1, the tertiary air is injected in the form of the swirl flow. This tertiary swirl air flow is, as compared with the straight advance air flow, rather difficult to be mixed with the straight advance fuel flow in the proximity of the burner exit, since a direction of the tertiary swirl air flow is different from that of the straight advance fuel flow. Further, since a static pressure in the central portion of the swirl flow is decreased when the strength of the swirl is increased, in a downstream portion of the flame flow, a recirculating flow including a flow directed toward the burner exit from the downstream portion of the flame, which is contrary to a flow direction of the fuel, is generated, with the result that, by such recirculating flow, the mixing of the tertiary air with the central flow in the downstream portion of the flame flow is promoted. Therefore, with the burner shown in FIG. 1, since the mixing of the tertiary air with the fuel is suppressed in the proximity of the burner and is promoted in the downstream portion of the flame flow, it is easy to create the reduction region necessary for performing the deoxidization of NOx and also to oxidize the residual combustibles after the deoxidization of NOx.

In order to obtain such an optimum condition regarding the mixing of the tertiary air with the central flow of the flame as described above, it is necessary to determine an optimum value of the strength of the swirl of the tertiary air, thereby improving efficiency of the generation of the swirl flow. To this end, it has been experimentally found that it is efficient to use the tertiary air passage longer than the other nozzles. With such improvement, the holding of flame is improved, since the stable circulating flow is created not only around the flame holder but also around the spacer 24 disposed between the secondary passage. The spacer 24 is so dimensioned that the voluminous recirculating flow is generated so as to stabilize the flame in addition to delaying the mixing of the tertiary air and the primary air, and the tertiary nozzle.

In the embodiment of FIG. 1, in order to obtain the longer tertiary air passage, said passage 6 is provided with an extension constituted by the block 28. A configuration of the passage extension may be appropriately selected, and thus, is not limited to the configuration of FIG. 1. It is efficient that a diameter of the extension is as large as possible; however, as in the case of boilers, when a combustion chamber around the burner is formed by water pipe(s), it is frequently impossible to increase the diameter of the extension, since it is difficult to modify the existing combustion chamber.

Figure 4:
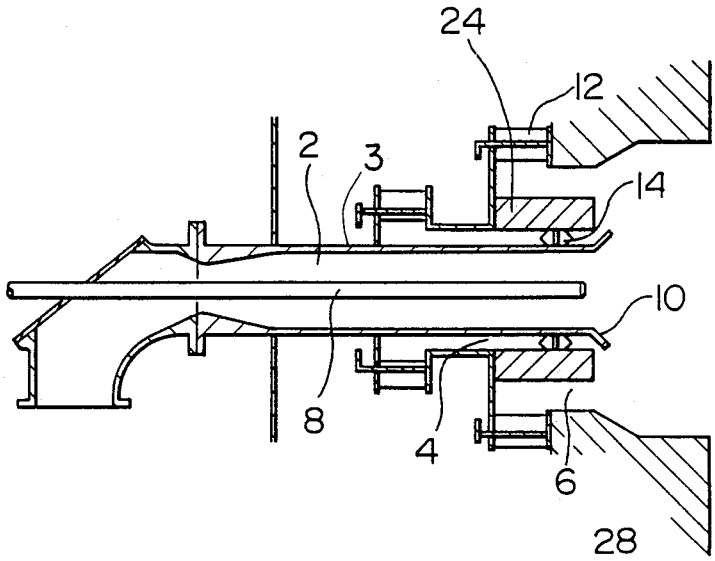
FIG. 4 is a longitudinal sectional view of a modification of the burner for pulverized coal shown in FIG. 1.

In the present invention, as shown in FIG. 4, the block 28 can be flared outwardly from the free end of the secondary air passage; in this case, it is easier to create the reduction region.

As can easily be imagined, it is efficient for the reduced NOx production to increase the dimension of the spacer 24 positioned between the secondary air passage and the tertiary air passage as large as possible so as to increase a clearance between the secondary air passage 4 and the tertiary air passage 6, thereby delaying the mixing of the tertiary air with the fuel; however, if the dimension of the spacer 24 is increased, an annular clearance forming the tertiary air passage 6 becomes smaller, with the result that it is difficult to manufacture the burner.

With the construction of the block 28 as shown in FIG. 4, if the dimension of the spacer 24 is increased, the same technical effect as that achieved by increasing the clearance between the secondary and tertiary passages is obtained, since the tertiary air can be injected along the flared inner wall of the block 28 by increasing the strength of the swirl of the tertiary air.

Furthermore, by modifying the passage for the pulverized coal to a dual passage construction, the present invention can be applied to burners in which the pulverized coal is supplied from a plurality of passages. Such burners have a disadvantage that operation and control of the burner are complex due to an additional operation regarding the separate delivery of the pulverized coal; however, on the contrary, they have an advantage that, since the mixing of the pulverized coal with the secondary igniting air is promoted by the separate delivery of the pulverized coal, the ignitability of the fuel and the holding of flame are improved. Therefore, the above-mentioned burners can easily create the reduction region due to the fact that the consumption of the oxygen in the proximity of the burner is promoted, and thus is effective for reducing the production of NOx.

Figure 5:
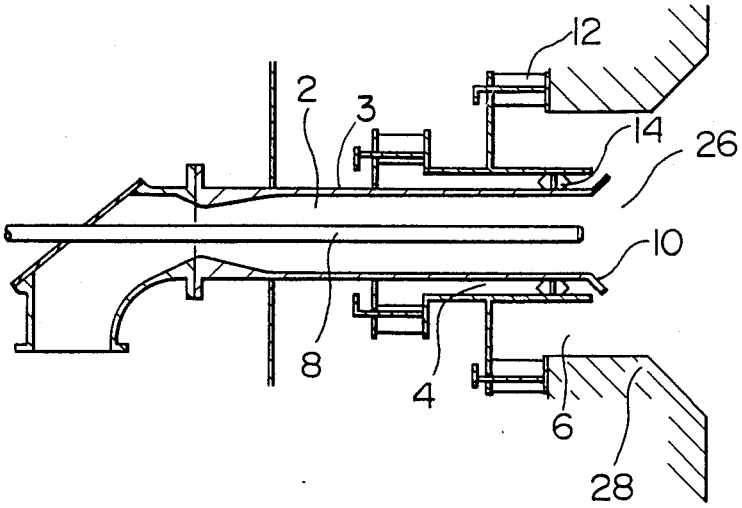
FIG. 5 is a longitudinal sectional view similar to FIG. 1, wherein a spacer is omitted.
Figure 6:
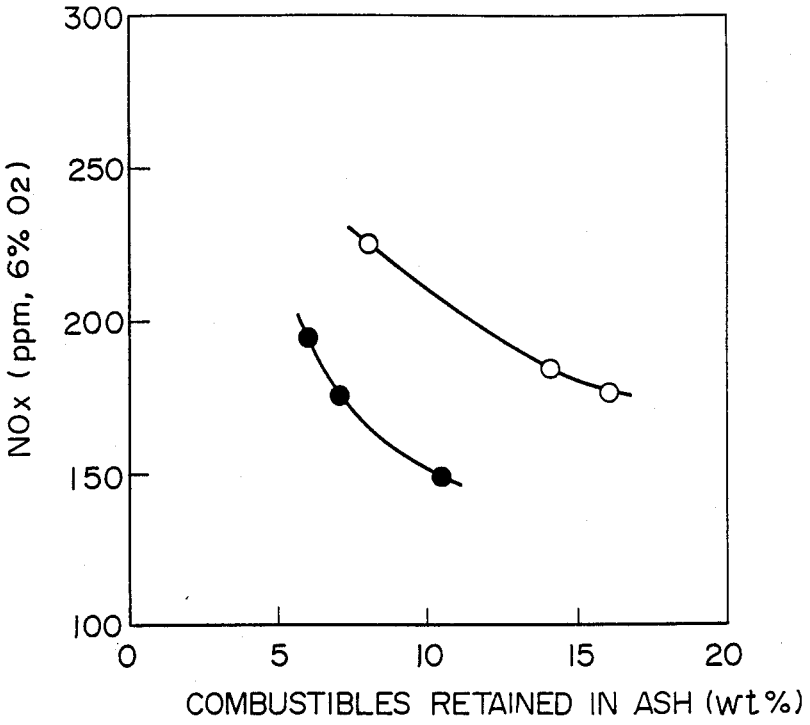
FIG. 6 is a diagram showing experimental relationships between NOx obtained by combustion of the pulverized coal and combustibles retained in ash by the use of the burners shown in FIGS. 1 and 5.

FIG. 6 shows experimental data obtained when the pulverized coal was burned by the use of the burner shown in FIG. 1 and the burner shown in FIG. 5 in which the spacer 24 is omitted. The coal used in the experiment contained 31.1 wt % of volatile matter, 53.2% of fixed carbon, 15.7% of ash and 1.04% of nitrogen. Further, the coal was crushed so that the pulverized coal includes about 80 wt % of coal particles each having a diameter of 74 μm or less. A coal feed rate was 300 kg/h and the coal was burned in a combustion passage formed by a water-cooled wall. The test data shown in FIG. 6 is the result of a test combustion measured when the residense time past for about two seconds.

FIG. 6 shows a relationship between NOx and the combustibles retained in ash. A unit of the combustibles retained in ash is a weight percentage (wt %) of the combustibles retained in a solid matter collected or obtained after the test combustion. In FIG. 6, open symbols show the result of the test conducted by the burner of FIG. 5 and solid symbols show the result of the test conducted by the burner of FIG. 1. Further, in the burner of FIG. 1 used in the test, a thickness of the spacer 24 was 50 mm. Referring to FIG. 6, it is clear that the more the combustibles retained in ash (i.e., the lower the efficiency of combustion), the less the NOx production. Further, as apparent from the diagram of FIG. 6, when the amount of the combustibles obtained by the burner of FIG. 1 is the same as that obtained by the burner of FIG. 5, the NOx production generated by the burner of FIG. 1 is less than that generated by the burner of FIG. 5, which proves the efficacy of the spacer.

Figure 7:
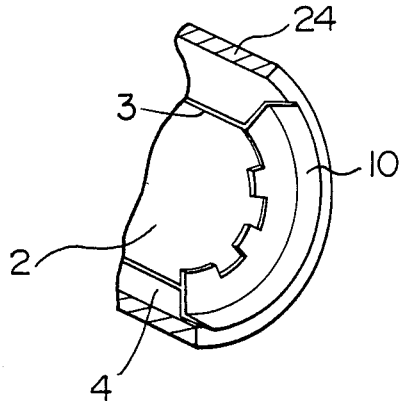
FIG. 7 is a partially broken perspective view showing an example of a flame holder incorporated in the burner for pulverized coal according to the present invention.

It should be noted that the flame holder 10 having a L-shaped construction as shown in FIG. 7 still improves the ignitability of the fuel and the holding of flame, as described in the Japanese Patent Laid-Open No. 226609/1985 and the U.S. Pat. No. 4,543,307. Also in the present invention, the combustibility of the fuel is still improved by the use of the L-shaped flame holder shown in FIG. 7.

Figure 8:
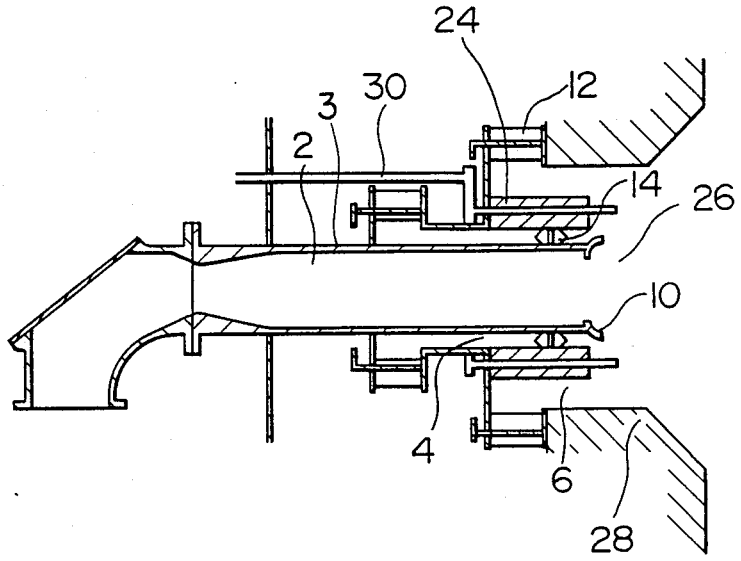
FIG. 8 is a longitudinal sectional view of a second embodiment of the burner for pulverized coal according to the present invention.

FIG. 8 shows the second embodiment of the present invention. In this second embodiment, the burner is provided with a gaseous fuel nozzle 30 in place of the liquid fuel nozzle 8 of FIG. 1, the gaseous fuel nozzle 30 passing through the spacer 24. With this construction, the burner of FIG. 8 enables the mixing of the gaseous fuel with the pulverized coal and the combustion of such mixture, and also enables that either the gaseous fuel or the pulverized coal is selectively burned by alternatively supplying the gaseous fuel or the pulverized coal (solid fuel). Furthermore, of course, if the liquid fuel nozzle 8 as shown in FIG. 1 is incorporated into the fuel passage 2 of the burner of FIG. 8, any of these fuels (liquid fuel, gaseous fuel and solid fuel) can be burned effectively.

Figure 9:
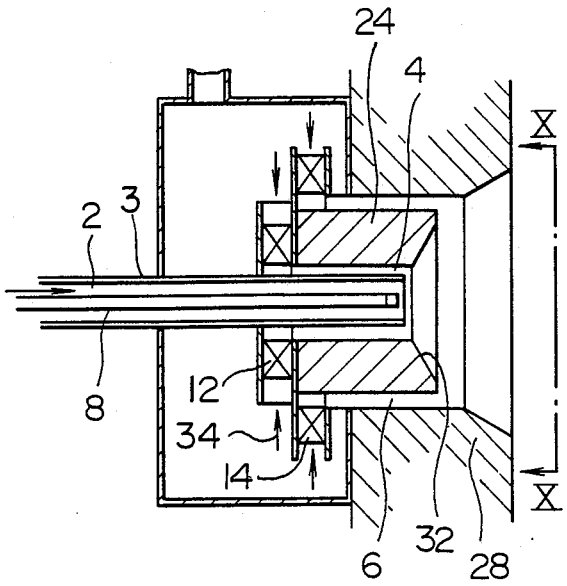
FIG. 9 is a longitudinal sectional view of a third embodiment of the burner for pulverized coal according to the present invention.
Figure 10:
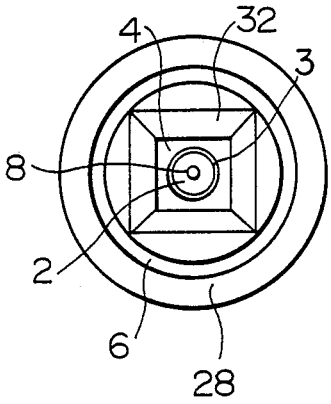
FIG. 10 is an end view looking along the line X—X of FIG. 9.

FIG. 9 is a longitudinal sectional view of the third embodiment of the burner for pulverized coal according to the present invention, and FIG. 10 is an end view of the burner looking along the line X—X of FIG. 9. The burner of the third embodiment differs from that of the first embodiment in that the spacer 24 positioned between the secondary air passage 4 and the tertiary air passage 6 has an inner surface of polygonal cross-section, and a polygonal flared end surface 32 is formed in proximity of the outlet of the secondary air passage 4.

Figure 11:
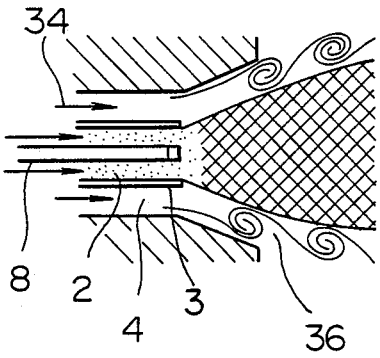
FIG. 11 is a partial longitudinal sectional view of the burner of FIG. 9 for explaining an operation of said burner.

FIG. 11 is a view for explaining the operation of the present invention. Each of the injected primary flow and the injected secondary air flow 34 forms swirls or eddies at four positions corresponding to apexes of the end surface 32, with the result that a mixing layer 36 can be easily created at a border between the injected flow of the pulverized coal and the injected secondary air flow, and the velocity of the flow or jet of the mixture of the primary carrier air with the pulverized coal is reduced or decelerated, thereby improving the ignitability of the fuel and the holding of flame by means of the formation of the swirls.

Figure 12:
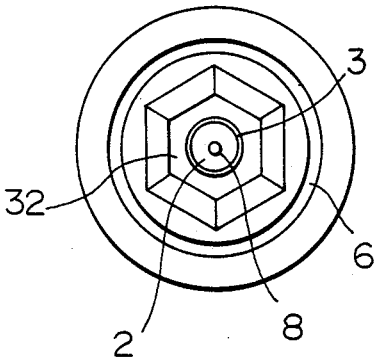
FIG. 12 is an end view showing a construction of a modification of the burner shown in FIG. 9.

FIG. 12 shows a modification of the burner of the present invention wherein the burner has a different secondary air passage 4. In this burner, the polygonal end surface 32 has a regular hexagonal cross-section. As well as the polygonal (square) end surface 32 of FIG. 10, the regular hexagonal end surface forms swirls in the secondary air at six positions corresponding to apexes of the end surface, thereby improving the ignitability of the pulverized coal as well.

Figure 13:
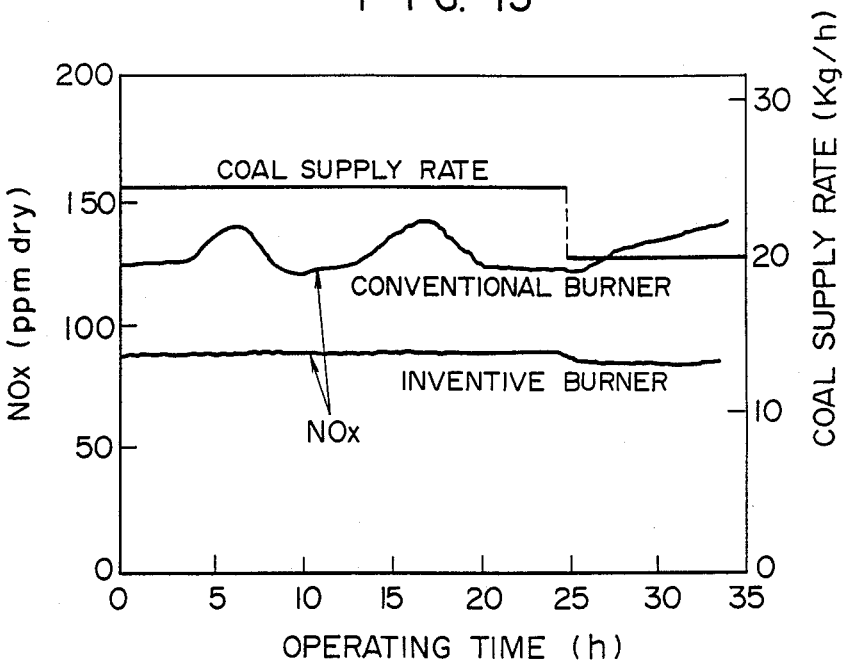
FIG. 13, FIG. 14 and FIG. 15 are test data diagrams showing effects obtained by the burner of FIG. 9.
Figure 14:
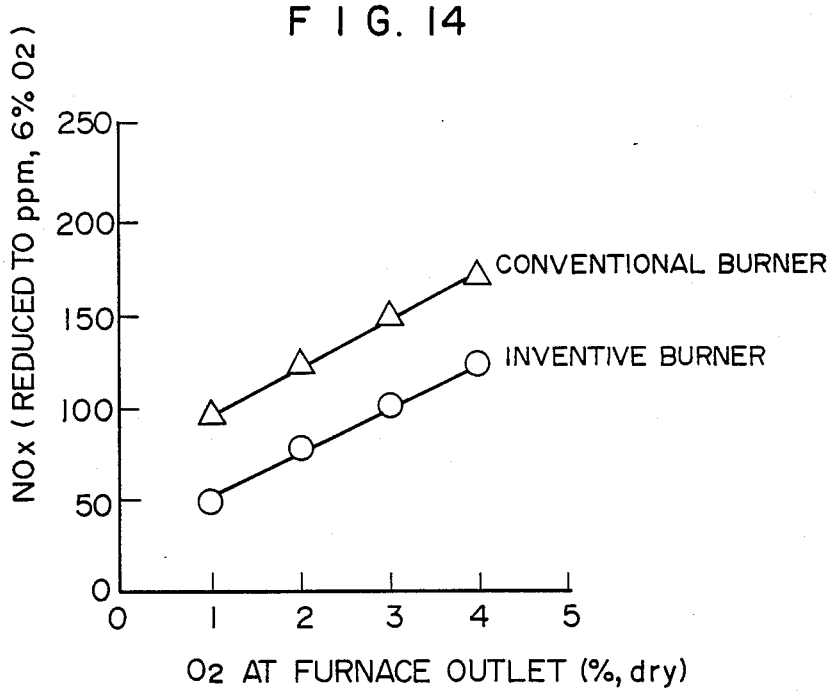
Figure 15:
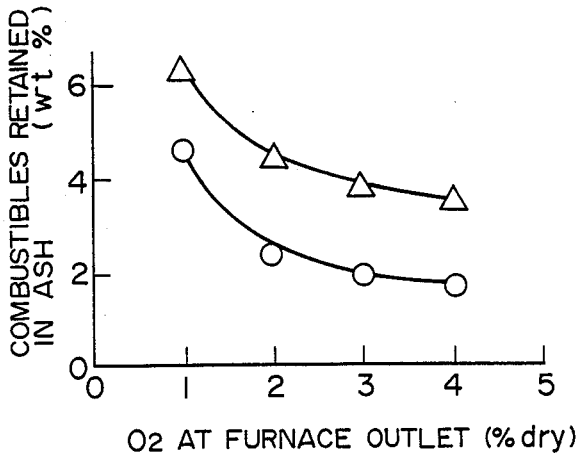

Next, the technical advantages obtainable by the present invention will now be fully explained with reference to FIGS. 13 to 15 showing the test data obtained by the burner of FIGS. 9 and 10. FIG. 13 shows the result of a test combustion of the pulverized coal fuel conducted under the condition that Pacific Ocean coal was crushed so as to obtain the pulverized coal including 80% of coal particles each having a diameter of 74 μm or less, the coal feed rate was selected to 20–50% kg/h and a combustion air flow rate was set to 1.1 as a stoichiometric ratio. In the test, different from the conventional burner having the cylindrical secondary air nozzle (passage), the burner (of the present invention) having the square secondary air nozzle and the square reducer positioned at the outlet of the secondary air passage was used. In comparison with amounts of NOx generated at an outlet of the combustion furnace (corresponding to three seconds of residence time) when the coal feed rate is 25 kg/h, it will be seen that the burner of the present invention produces less NOx than that of the conventional burner by about 70 ppm and that there is little change in the rate of the NOx generation even with time.

On the other hand, in the conventional burner, it will be seen that a large amount of NOx production is generated. This is supposed that, in the conventional burner, as well as the ash is adhered to the outlet of the pulverized coal nozzle, the flow of the pulverized coal and the secondary air jet are offset, which results in an offset of the flame itself, thereby making the formation of low oxygen region in the center of the flow still difficult. In other words, the conventional burner has a disadvantage that the low oxygen region for promoting the deoxidization of NOx can not stably be formed.

Furthermore, when the coal feed rate was changed from 25 kg/h to 20 kg/h while maintaining the stoichiometric ratio to 1.1, in the conventional burner the amount of NOx production was remarkably changed (see FIG. 13). On the contrary, as apparent from FIG. 13, in the burner of the present invention (inventive burner), the amount of the NOx production was little changed. This proves that the burner of the present invention has an excellent ignitability and holding of flame.

FIGS. 14 and 15 show an example of other test data for supporting the advantages of the present invention, respectively. More particularly, FIG. 14 shows a relationship between "$O_2$ at furnace outlet" and density of the generated "NOx" obtained by a test combustion conducted under the condition that the coal supply rate was maintained to a constant value of 25 kg/h and the flow rate of the tertiary air was changed. It is apparent from FIG. 14 that the burner of the present invention can remarkably reduce the NOx production. Next, FIG. 15 shows the result of analysis of the combustibles retained in a sampling char gathered at the exit of the combustion furnace in the test combustion regarding FIG. 4. It will be seen that in the burner of the present invention, the combustibles in the char is very little, as compared with that obtained by the conventional burner, and thus, high combustion efficiency can be achieved. Accordingly, from the test data of FIGS. 13–15, it will be appreciated that the present invention has the remarkable advantages of improving the ignitability of the fuel and the holding of flame, and achieving high combustion efficiency and low production of NOx.

Figure 16:
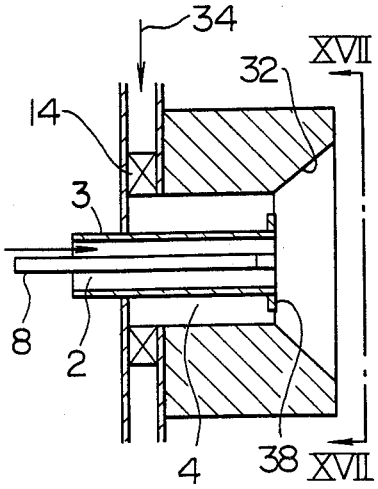
FIG. 16 is a longitudinal sectional view showing another modification of the burner shown in FIG. 9.
Figure 17:
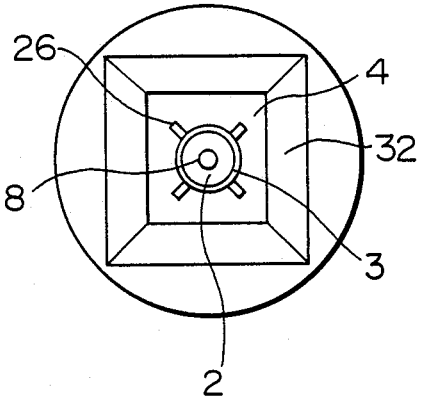
FIG. 17 is an end view looking along the line XVII—XVII of FIG. 16.
Figure 18:
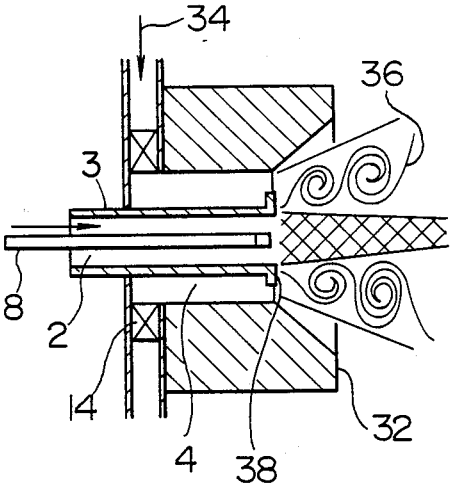
FIG. 18 is a longitudinal sectional view of the burner of FIG. 16 for explaining an operation of said burner.

Lastly, another embodiment of the present invention will be fully explained with reference to FIG. 16, FIG. 17 and FIG. 18. The burner shown in FIG. 16 is similar to that of FIG. 9; however, the burner of FIG. 16 differs in construction from that of FIG. 9 in the point that the burner has flame holder(s) 38 projecting radially outwardly from the outlet portion of the tube 3 (into the secondary air passage). When the secondary air passage 4 is the square passage as shown in FIG. 10, four flame holders 38 are arranged on the tube end 3 at four positions corresponding to the four apexes of the square, as shown in FIG. 17 which is is an end view looking along the line XVII—XVII of FIG. 16. With the flame holders so arranged, negative pressure region is generated at a downstream side of the flame holders 38, thereby forming swirls therein, as shown in FIG. 18, with the result that the area of the mixing layer 36 is enlarged, whereby the mixing of the pulverized coal with the firing secondary air is still promoted, the promotion of the ignitability is still improved, and the stable flame is formed.

While the invention has been described in connection with preferred embodiments thereof, it will be understood that many modifications will be apparent to those of ordinary skill in the art; and that this application is intended to cover any adaptations or variations thereof. Therefore, it is manifestly intended that the present invention be only limited by the claims and the equivalents thereof.

What is claimed is:

1. A low NOx burner comprising:

means for defining a pulverized coal passage for injecting a flow of a mixture of pulverized coal and primary air;

means for defining a secondary air passage arranged externally of and coaxially with said pulverized coal passage;

means for defining a tertiary air passage arranged externally of said secondary air passage and disposed coaxially with said pulverized coal passage with an outer peripheral wall extending parallel to said pulverized coal passage;

swirl flow generator means for injecting secondary air and tertiary air as a respective swirl flow;

said secondary air passage defining means and said tertiary air passage defining means including spacer means disposed to project between said secondary air passage and said tertiary air passage and having a thickness sufficient for forming a recirculation flow between said secondary air and said tertiary air at a location adjacent to said spacer means which has an outer peripheral surface constituting an inner peripheral wall of said tertiary air passage with said outer peripheral surface extending parallel to said pulverized coal passage; and flame holder means provided on a free end of said pulverized coal passage defining means for forming a swirl flow between said flow of the mixture of the pulverized coal and the primary air and a flow of said secondary air.

2. A low NOx burner according to claim 1, wherein said tertiary air passage includes an extension comprising a block projecting axially across a free end of said secondary air passage.

3. A low NOx burner comprising:

means for defining a pulverized coal passage for injecting a flow of a mixture of pulverized coal and primary air;

means for defining a secondary air passage arranged externally of and coaxially with said pulverized coal passage;

means for defining a tertiary air passage arranged externally of said secondary air passage and disposed coaxially with said pulverized coal passage with at least a portion of an outer peripheral wall of said tertiary air passage extending parallel to said pulverized coal passage;

swirl flow generator means for injecting secondary air and tertiary air as a respective swirl flow;

said secondary air passage defining means and said tertiary air passage defining means including spacer means disposed to project between said secondary air passage and said tertiary air passage and having a thickness sufficient for recirculation flow between said secondary air and said tertiary air at a location adjacent to said spacer means which has an outer peripheral surface constituting an inner peripheral wall of said tertiary air passage with said outer peripheral surface extending parallel to said pulverized coal passage; and a gaseous fuel nozzle disposed in said spacer means.

4. A low NOx burner according to claim 3, wherein said tertiary air passage includes an extension comprising a block projecting axially across a free end of said secondary air passage.

5. A low NOx burner comprising:

means for defining a pulverized coal passage for injecting a flow of a mixture of pulverized coal with primary air;

means for defining a secondary air passage arranged externally of and coaxially with said pulverized coal passage;

means for defining a tertiary air passage arranged externally of said secondary air passage and disposed coaxially with said pulverized coal passage;

swirl flow generator means for injecting secondary air and tertiary air as a respective swirl flow;

said means for defining a secondary air passage and said means for defining a tertiary air passage defining spacer means having a thickness sufficient to delay the mixing of said secondary air with said tertiary air and to form a swirl flow between said secondary air and said tertiary air;

flame holder means provided on a free end of said pulverized coal passage defining means for forming a swirl flow between said flow of the mixture of the pulverized coal with the primary air and a flow of said secondary air; and a gaseous fuel nozzle disposed in said spacer means.

6. A low NOx burner according to claim 5, wherein said tertiary air passage includes an extension comprising a block projecting axially across a free end of said secondary air passage.

7. A low NOx burner comprising:

means for defining a pulverized coal passage for injecting a flow of a mixture of pulverized coal with primary air;

means for defining a secondary air passage arranged externally of and coaxially with said pulverized coal passage;

means for defining a tertiary air passage arranged externally of said secondary air passage, said tertiary air passage defining means including an extension projecting axially across free ends of said pulverized coal passage and said secondary air passage and having an outer peripheral wall extending parallel to said pulverized coal passage;

swirl flow generator means for injecting secondary air and tertiary air as a respective swirl flow; and said secondary air passage defining means and said tertiary air passage defining means including spacer means disposed to project between said secondary air passage and said tertiary air passage for forming a recirculation flow between said secondary air and said tertiary air at a location adjacent to said spacer means which has an outer peripheral surface constituting an inner peripheral wall of said tertiary air passage with the outer peripheral surface extending parallel to said pulverized coal passage;

wherein said pulverized coal passage has a cylindrical injecting outlet, said secondary air passage has a secondary air injecting outlet defined by said spacer means in the form of a polygon surrounding said injecting outlet of the pulverized coal passage and a polygonal flared end surface in proximity to the outlet of said secondary air passage, said tertiary air passage having a cylindrical tertiary air injecting outlet surrounding said secondary air injecting outlet.

8. A low NOx burner according to claim 7, wherein a plurality of projections are arranged on an outer periphery of the said injecting outlet of the pulverized coal passage at positions corresponding to apexes of the polygonal flared end surface.

9. A low NOx burner according to claim 4, wherein walls define outlets of said secondary air passage and said tertiary air passage and comprise refractory material, said extension of the tertiary air passage being positioned to project beyond said outlet of the secondary air passage.

10. A low NOx burner comprising:

means for defining a pulverized coal passage for injecting a flow of a mixture of pulverized coal with primary air;

means for defining a secondary air passage arranged externally of and coaxially with said pulverized coal passage;

means for defining a tertiary air passage arranged externally of said secondary air passage and disposed coaxially with said pulverized coal passage;

swirl flow generator means for injecting secondary air and tertiary air as a respective swirl flow; and said pulverized air passage defining means and said secondary air passage defining means together including spacer means disposed between said secondary air passage and said tertiary air passage and having a thickness sufficient to delay the mixing of said secondary air with said tertiary air and to form a swirl flow between said secondary air and said tertiary air wherein said spacer means has a projecting end face in a plane perpendicular to axes of said pulverized coal passage and said tertiary air passage and provides a space on a downstream side of said projecting end face in which recirculation flow is generated to delay a mixing of the tertiary air with the primary air.

11. A low NOx burner according to claim 1, wherein said spacer means has a projecting end face in a plane perpendicular to axes of said pulverized coal passage and said tertiary air passage and provides a space on a downstream side of said projecting end face in which recirculation flow is generated to delay a mixing of the tertiary air with the primary air.

12. A low NOx burner according to claim 3, wherein said spacer means has a projecting end face in a plane perpendicular to axes of said pulverized coal passage and said tertiary air passage and provides a space on a downstream side of said projecting end face in which recirculation flow is generated to delay a mixing of the tertiary air with the primary air.

13. A low NOx burner according to claim 5, wherein said spacer means has a projecting end face in a plane perpendicular to axes of said pulverized coal passage and said tertiary air passage and provides a space on a downstream side of said projecting end face in which recirculation flow is generated to delay a mixing of the tertiary air with the primary air.

14. A low NOx burner according to claim 7, said spacer means has a projecting end face in a plane perpendicular to axes of said pulverized coal passage and said tertiary air passage and provides a space on a downstream side of said projecting end face in which recirculation flow is generated to delay a mixing of the tertiary air with the primary air.

15. A low NOx combustor comprising:

a primary air passage through flow of a mixture of a primary air with pulverized coal is injected into a combustion chamber of said burner;

means forming a secondary air passage disposed radially outwards of said primary air passage, through which secondary air is injected into said chamber and a tertiary air passage disposed radially outwards of said secondary air passage, through which tertiary air is injected into said chamber, an axis of said tertiary air passage being parallel at a projection end portion thereof with an axis of said primary air passage, so that primary air and said tertiary air are projected into said chamber in the same direction;

a swirl flow generator disposed in said secondary air passage for generating swirl flow in an injected secondary air flow and for directing it towards an injected tertiary air flow; and said means forming the secondary air passage and the tertiary air passage includes a spacer disposed to project between said secondary air passage and said tertiary air passage, said spacer extending to a projecting end face thereof, which end face exists in a plane perpendicular to axes of said primary air passage and said tertiary air passage, and said spacer providing a space in a downstream side of said projecting end face, in which recirculation flow is generated, at a location adjacent to said spacer which has an outer peripheral surface constituting an inner peripheral wall of said tertiary air passage with said outer peripheral surface extending parallel to said primary air passage.

16. A low NOx burner according to claim 15, wherein a swirl flow generator is arranged in said tertiary air passage to inject the tertiary air as swirl flow.

17. A low NOx burner according to claim 15, wherein said tertiary air passage includes an extension constituted by a block projecting axially across a free end of said secondary air passage.

18. A low NOx burner according to claim 17, wherein said passage extension of the tertiary air passage is flared outwardly from a position corresponding to the free end of the secondary air passage.

* * * * *